US010661983B2

(12) United States Patent
Monaco et al.

(10) Patent No.: US 10,661,983 B2
(45) Date of Patent: May 26, 2020

(54) DOUBLE-WALLED WASTE CONTAINER

(71) Applicant: D.T.B.B.J. Properties, LLC, Bucryus, OH (US)

(72) Inventors: Timothy A. Monaco, Galion, OH (US); Bobby A. Monaco, Bucryus, OH (US)

(73) Assignee: D.T.B.B.J. PROPERTIES, LLC., Bucryus, OH (US)

( * ) Notice: Subject to any disclaimer, the term of this patent is extended or adjusted under 35 U.S.C. 154(b) by 30 days.

(21) Appl. No.: 16/202,338

(22) Filed: Nov. 28, 2018

(65) Prior Publication Data

US 2019/0193932 A1 Jun. 27, 2019

Related U.S. Application Data

(63) Continuation of application No. 15/431,155, filed on Feb. 13, 2017, now Pat. No. 10,144,583.

(60) Provisional application No. 62/294,347, filed on Feb. 12, 2016.

(51) Int. Cl.

| | |
|---|---|
| ***B65D 90/00*** | (2006.01) |
| ***B65F 1/02*** | (2006.01) |
| ***B65F 1/14*** | (2006.01) |
| ***B65F 1/12*** | (2006.01) |
| ***B65D 88/12*** | (2006.01) |
| ***B65D 90/02*** | (2019.01) |

(52) U.S. Cl.

CPC ..... *B65F 1/02* (2013.01); *B65D 88/123* (2013.01); *B65D 90/008* (2013.01); *B65D 90/028* (2013.01); *B65F 1/122* (2013.01); *B65F 1/1473* (2013.01); *B65F 2210/13* (2013.01); *B65F 2210/132* (2013.01); *B65F 2210/148* (2013.01)

(58) Field of Classification Search

CPC .... B65F 1/1473; B65F 1/122; B65F 2210/13; B65F 2210/148; B65F 1/02; B65D 90/008; B65D 90/02; B65D 90/028

See application file for complete search history.

(56) References Cited

U.S. PATENT DOCUMENTS

| | | | |
|---|---|---|---|
| 4,257,322 | A | 3/1981 | McDermott |
| 4,280,640 | A | 7/1981 | Daloisio |
| 4,838,418 | A | 6/1989 | Teixeira |
| 4,884,711 | A | 12/1989 | Bomhard et al. |
| 4,886,164 | A | 12/1989 | Stein et al. |
| 5,180,076 | A | 1/1993 | Hundt |
| 5,423,448 | A | 6/1995 | Pedigo |
| 5,609,810 | A | 3/1997 | Fujiwara et al. |
| 6,631,821 | B2 | 10/2003 | Vourganas |
| 8,141,921 | B2 | 3/2012 | Apps et al. |
| 8,562,212 | B1 | 10/2013 | Strickland et al. |
| 8,578,846 | B2 | 11/2013 | Sherwood et al. |
| 8,631,940 | B2 | 1/2014 | Hay et al. |
| 2006/0045680 | A1 | 3/2006 | Lorenz et al. |
| 2007/0138173 | A1 | 6/2007 | Nielsen |
| 2007/0289979 | A1 | 12/2007 | Neri |
| 2008/0197645 | A1 | 8/2008 | Hatamian et al. |

(Continued)

*Primary Examiner* — Brian L Swenson
(74) *Attorney, Agent, or Firm* — McCarter & English, LLP

(57) ABSTRACT

The double-walled waste container provides an open-top roll-off container being rectangular in shape and having latching door portions at one end. The container employs a double wall construction to minimize damage, improve strength, and reduce weight. Additionally, the container provides a plurality of drain apertures which extend a full length of the container to drain off accumulated liquids and to prevent corrosion of the container.

31 Claims, 6 Drawing Sheets

(56) References Cited

U.S. PATENT DOCUMENTS

| | | | |
|---|---|---|---|
| 2008/0256878 | A1 | 10/2008 | Berns et al. |
| 2009/0179444 | A1 | 7/2009 | Apps et al. |
| 2010/0122981 | A1 | 5/2010 | Sims |
| 2010/0233503 | A1 | 9/2010 | Zachman et al. |
| 2012/0296781 | A1 | 11/2012 | Edwards et al. |
| 2014/0231422 | A1 | 8/2014 | Kochanowski |
| 2014/0263379 | A1 | 9/2014 | Brennan, Jr. |
| 2015/0300321 | A1 | 10/2015 | Haar |
| 2016/0288992 | A1 | 10/2016 | Jorgensen et al. |
| 2016/0288993 | A1 | 10/2016 | Hu et al. |

DOUBLE-WALLED WASTE CONTAINER

CROSS-REFERENCE TO RELATED APPLICATIONS

This application is a continuation claiming the benefit under 35 U.S.C. § 120 to U.S. patent application Ser. No. 15/431,155, filed on Feb. 13, 2017, which claims benefit under 35 U.S.C. § 119 to similarly-titled U.S. Provisional Patent Application No. 62/294,347, filed Feb. 12, 2016, which are hereby incorporated by reference in their entireties as part of the present disclosure.

FIELD OF THE INVENTION

The present invention relates generally to the field of roll-off containers and more specifically relates to double-walled waste containers.

BACKGROUND OF THE INVENTION

A roll-off container is generally an open top dumpster that is usually rectangular in shape with wheels to help roll the dumpster into place. The roll-off container is designed to be transported by a special truck or similar vehicle. Roll-off containers are commonly used to carry loads of construction and demolition waste or similar types of debris or waste. Most roll-off containers have a door, or pair of doors, on the end to allow user access to fill the container and also to empty the container at the waste disposal site, which may include tilting the roll-off container to dump its contents. It is common for a roll-off container to have an open top to allow better access to the container during filling.

One limitation with a roll-off container is that they can often accumulate water or other liquids, which can cause corrosion problems when the container is constructed of a ferrous material. These corrosion problems can limit the useful life of a roll-off container. Attempts have been made to coat the surfaces of a roll off container with anti-corrosion coatings, which can be expensive and time consuming as is the use of a lid. Also, anti-corrosion coatings are prone to being damaged during use of the roll-off container.

Additionally, during use of the roll-off container, the exterior surface may show bulges and damage when large or heavy objects are loaded into the roll-off container, making the roll-off container unsightly. Therefore, a suitable solution is desired to prevent corrosion, increase the useful life, and maintain the appearance of a roll-off container.

Various attempts have been made to solve problems found in roll-off containers. Among these are found in: U.S. Pat. and Pat. App. Pub. U.S. Pat. No. 3,897,882 to Budoff, U.S. Pat. No. 4,844,336 to Huber et al., U.S. Pat. No. 5,294,016 to Crenshaw, U.S. Pat. No. 6,955,520 to Flerchinger et al., U.S. Pat. No. 8,261,918 to Powell et al., and 2010/0025407 to Benson. These prior art references are representative of roll-off containers.

None of the above inventions and patents, taken either singly or in combination, is seen to describe the invention as claimed. Thus, a need exists for a reliable double-walled waste container, and to avoid the above-mentioned problems.

SUMMARY OF THE INVENTION

In accordance with a first aspect, the present invention is directed to a double-walled waste container comprising a first sidewall defining a first end and a second end, and a second sidewall defining a first end and a second end. The second sidewall is spaced relative to the first sidewall and is approximately parallel thereto. A first end wall extends between the first ends of the first and second sidewalls. A second end wall extends between the second ends of the first and second sidewalls. A floor extends substantially between the first and second side walls and substantially between the first and second end walls. The first and second sidewalls, the first and second end walls, and the floor define an interior for receiving waste. Each sidewall comprises a double-wall configuration comprising a first wall and a second wall fixedly secured to the first wall. Each second wall comprises a plurality of adjacent second wall portions. Each adjacent second wall portion defines a substantially flat wall portion and angled edge wall portions located on opposite sides of the flat wall portion relative to each other. Each angled edge wall portion is welded to an adjacent angled edge wall portion and/or to the first wall, and the second and first walls define a plurality of vertically extending spaces therebetween.

In some embodiments of the present invention, each inner wall is substantially flat, and each substantially flat outer wall portion is approximately parallel to the respective inner wall. In some embodiments, each angled edge wall portion is oriented at an acute angle relative to the respective substantially flat wall portion. In some embodiments, the angled edge wall portions of adjacent outer wall portions are welded to each other and/or to the inner wall to fixedly secure the outer wall to the inner wall. In some embodiments, a plurality of angled edge wall portions overlap and are welded to each other. In some such embodiments, a plurality of outer wall portions include one angled edge wall portion welded to an adjacent angled edge wall portion and the other angled edge wall portion welded to the inner wall. In some embodiments, the angled edge portions welded to each other are oriented approximately perpendicular to each other. In some embodiments, the outer wall forms a substantially flat exterior surface defined by adjacent substantially flat wall portions and welds extending between adjacent angled edge portions of the outer wall portions. In some such embodiments, one or more of the substantially flat wall portions are wider than other substantially flat wall portions to facilitate the application of signage thereon.

In accordance with another aspect, the present invention is directed to a container which comprises a first sidewall, a second sidewall which is parallel to the first sidewall, a rear wall which is affixed between a first perimeter edge of the first and second sidewalls, a floor which is affixed to a bottom perimeter edge of the first sidewall, the second sidewall, and the rear wall thereby defining an interior, a cap which is affixed to a top perimeter edge of the first sidewall, the second sidewall, and the rear wall, a first door which is hingedly attached to a second perimeter edge of the first sidewall, a second door which is hingedly attached to a second perimeter edge of the second sidewall, a pair of wheels which are secured beneath the floor subjacent the second perimeter edge and a pair of rails secured between the pair of wheels beneath the floor. The first and second sidewalls comprise a double wall. In another embodiment, the pair of wheels are secured beneath the floor subjacent the second perimeter edge of the first sidewall and the second perimeter edge of the second sidewall. In another embodiment, an existing waste container is secured within the container.

The double wall may further comprise of an outer wall having a plurality of "U"-shaped wall portions and an inner wall. Each "U"-shaped wall portion is welded to an adjacent "U"-shaped wall portion in an overlapping manner forming the outer wall. The outer wall is secured to the inner wall thereby forming a plurality of interior spaces within the double wall. In another embodiment, the first sidewall, second sidewall, rear wall, first door and second door comprise a double wall comprising an outer wall comprising a plurality of "U"-shaped wall portions, and an inner wall.

The double wall may also comprise a unitary corrugated outer wall. The first door and the second door may comprise the double wall. The first sidewall, second sidewall, first door and second door may comprise a double wall.

A door securement device may be attached to the first door for securing the first door to the second door. The door securement device may further comprise of a pair of locking plates which are secured to an outer face of the first door with each having a locking pin aperture, a plurality of latches which are disposed near a perimeter edge of the first door opposite the first sidewall, a plurality of rod brackets which are secured to an outer face of the second door disposed near a perimeter edge of the second door opposite the second sidewall, a pivot rod which is vertically held in position by the rod brackets, a release bar which is perpendicularly secured to the pivot rod and a plurality of hooks which are perpendicularly secured to the pivot rod and aligned with the plurality of latches.

The locking plate may be perpendicularly secured to the first door such that the locking pin apertures are aligned. When the first door and second door are closed, movement of the release bar towards the first door results in a corresponding rotation of the pivot rod which in turn results in a corresponding rotation of the plurality of hooks. When the release bar is flush with the first door, each hook becomes removably engaged with each latch. When the release bar is flush with the first door, the release bar is positioned between the locking plates behind each locking pin aperture. When the release bar is positioned between the locking plates behind each locking pin aperture, a locking pin is capable of being inserted through each locking pin aperture thereby securing the release bar in place.

At least one drain aperture may be located on the floor between an inner wall and an outer wall of the double wall. The drain aperture is located below and in fluid communication with one or more vertically extending spaces in the double wall to allow drainage of fluids therethrough. Each drain aperture is aligned with one or more vertically extending spaces in the double wall for draining fluid therefrom. Each rail may have at least one chamfered edge.

In some embodiments wherein each outer wall portion is substantially "U"-shaped, the substantially flat wall portion defines the base of the U-shape and the outer angled edge wall portions form the legs of the U-shape.

In some embodiments, each vertically extending space extends from approximately the top of the double wall to approximately the bottom of the double wall. Each vertically extending space further extends laterally between the angled edge wall portions of the respective outer wall portion.

In some embodiments, each sidewall includes a cap affixed to an upper edge of the sidewall and covering the vertically extending spaces therein.

In some embodiments, both the first and second sidewalls define said double wall configuration, and the floor defines at least one first drain aperture located below the first sidewall and in fluid communication with one or more vertically extending spaces therein, and at least one second drain aperture located below the second sidewall and in fluid communication with one or more vertically extending spaces therein. Each drain aperture is one or more of longitudinal shaped, oval shaped or circular shaped.

In some embodiments, one end wall comprises at least one door hingedly mounted thereon. In some embodiments, the end wall comprises a first door hingedly mounted adjacent to an edge of the first sidewall and a second door hingedly mounted adjacent to an edge of the second sidewall. The door, when in the closed position, rests on the underlying floor and/or end wall.

In some embodiments, the container further comprises a plurality of wheels secured beneath the floor. In some embodiments, the waste container further comprises a plurality of rails secured beneath the floor. At least one end of the plurality of rails is chamfered to facilitate loading or unloading of the container.

In some embodiments, a plurality of the outer wall portions are contiguous, and each of a plurality of such outer wall portions include contiguous angled edge portions on at least one side thereof.

In some embodiments, at least one end wall further defines the double wall configuration.

In some embodiments, each of the first and second sidewalls includes a respective double wall.

In some embodiments, the door securement device of the container comprises a plurality of locking plates secured to an outer face of the first door, a plurality of latches disposed near a perimeter edge of the first door, a plurality of rod brackets secured to an outer face of the second door disposed near a perimeter edge of the second door, a pivot rod vertically held in position by the rod brackets, a release bar secured to the pivot rod, and a plurality of hooks secured to the pivot rod and aligned with the plurality of latches. Each locking plate defines a locking pin aperture and is secured to the door such that the locking pin apertures are aligned. When the first door and second door are closed, movement of the release bar towards the first door results in a corresponding rotation of the pivot rod and a corresponding rotation of the plurality of hooks. When the release bar is substantially flush with the first door, each hook is removably engaged with a respective latch and the release bar is positioned between the locking plates behind each locking pin aperture. When the release bar is positioned between the locking plates behind each locking pin aperture, a locking pin is configured for insertion through each locking pin aperture to secure the release bar.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
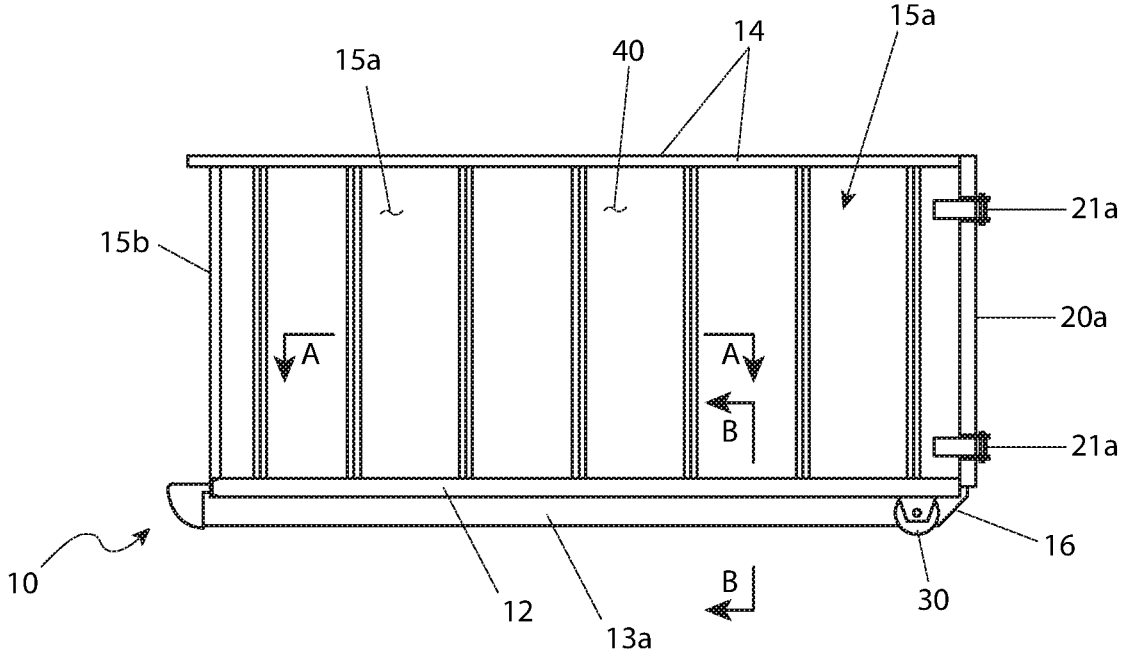
FIG. 1 is a side perspective view of a double-walled waste container condition, according to an embodiment of the present invention.

10 double-walled waste container
12 floor weldment
13*a* first rail
13*b* second rail
14 cap weldment
15*a* sidewall
15*b* rear wall
16 cantilevered rail portion
20*a* left side door half
20*b* right side door half
21*a* left side hinge
21*b* right side hinge
23 door latch weldment
24*a* release bar
24*b* locking pin
24*c* locking plate
25 pivot rod
26 rod bracket
27 hook
28 latch
30 wheel assembly
40 outer wall
40*a* outer wall portion
50 inner wall
60 drain aperture
62 weld
100 existing waste container
110 gusset

DETAILED DESCRIPTION OF THE PREFERRED EMBODIMENT

Figure 3A:
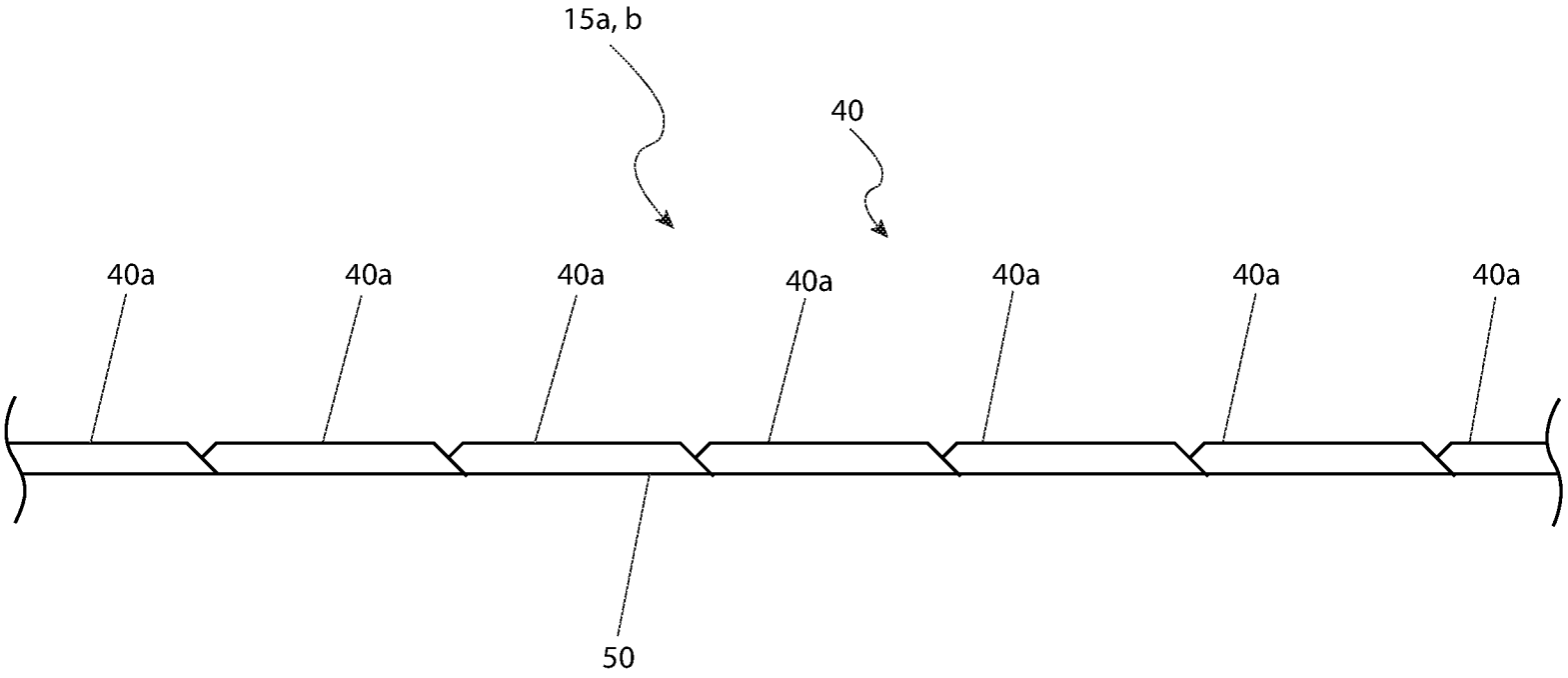
FIG. 3*a* is a sectional view of a double wall portion 15*a*, 15*b* of the double-walled waste container 10 taken along section line A-A (see FIG. 1), according to an embodiment of the present invention.
Figure 3B:
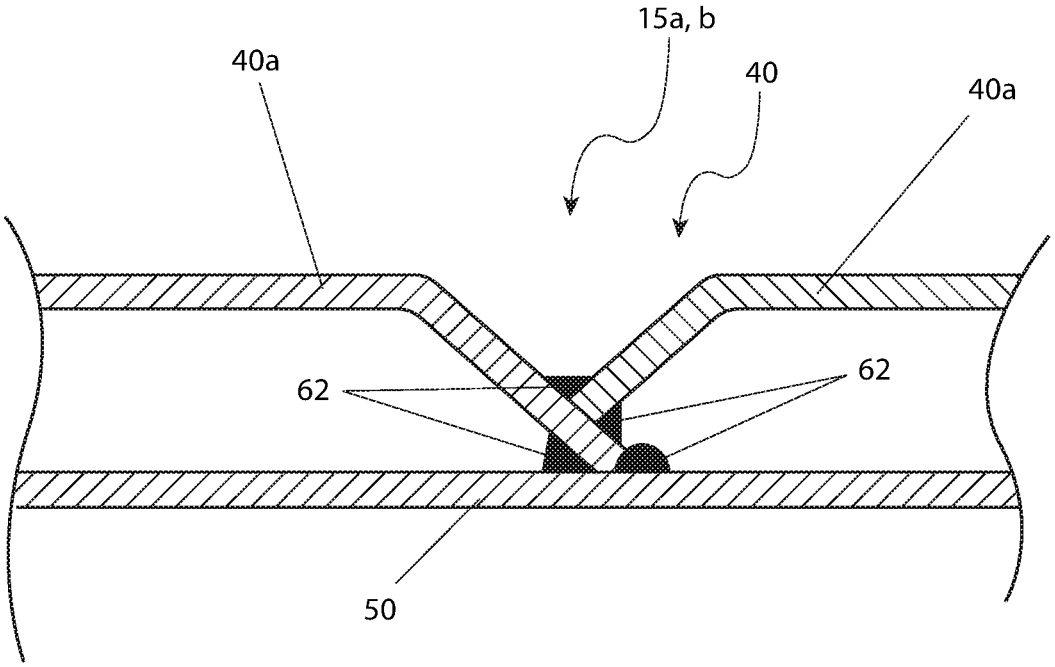
FIG. 3*b* is a close-up sectional view of the sidewall 15*a* also taken along section line A-A (see FIG. 1), illustrating a welded construction of the inner wall 50 and outer wall 40*a* portions, according to an embodiment of the present invention.
Figure 3C:
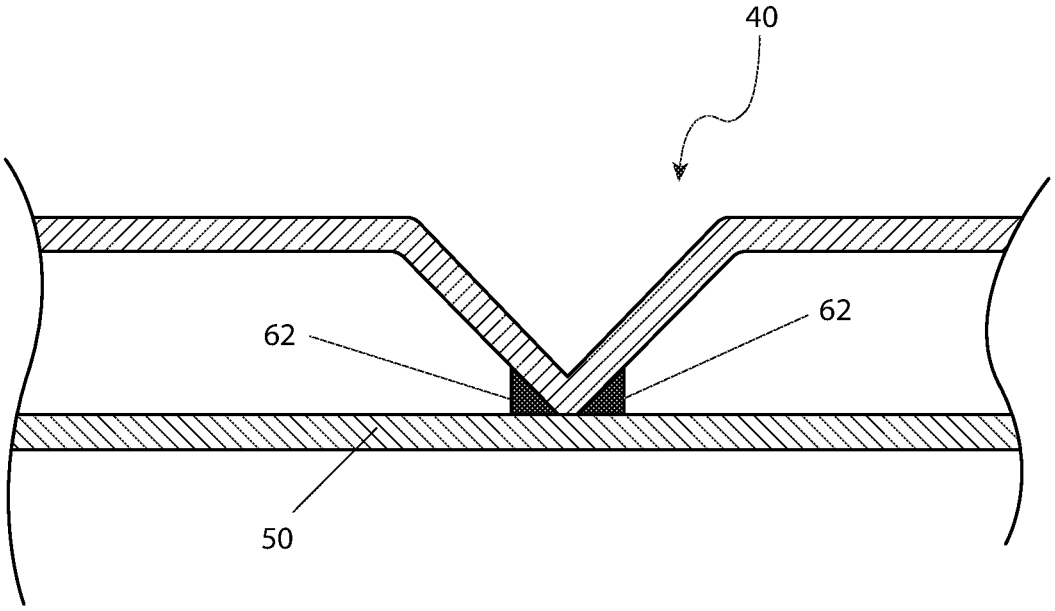
FIG. 3*c* is a close-up sectional view of the sidewall 15*a* also taken along section line A-A (see FIG. 1), illustrating a welded construction of the inner wall 50 and alternate outer wall 40, according to an embodiment of the present invention.
Figure 4:
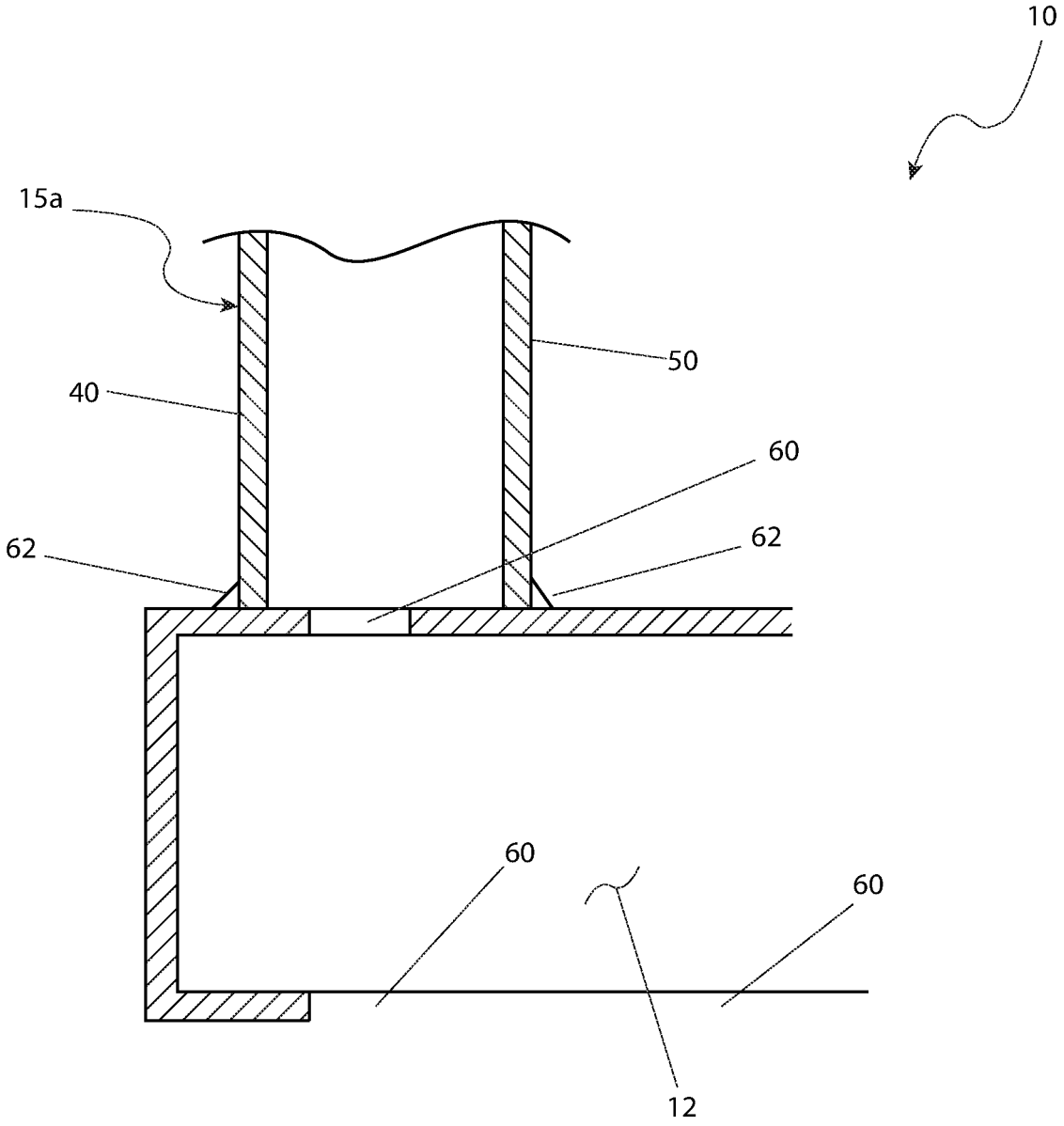
FIG. 4 shows a cross-sectional view taken along section line B-B (see FIG. 1), illustrating drain aperture portions 60 and a location where the sidewall 15*a* affixes to a floor weldment portion 12, according to an embodiment of the present invention; and, FIG. 5 is a sectional view taken along a horizontal plane through a sidewall 15*a* depicting attachment of the sidewall 15*a* to an existing waste container 100, according to an alternate embodiment of the invention.
Figure 5:
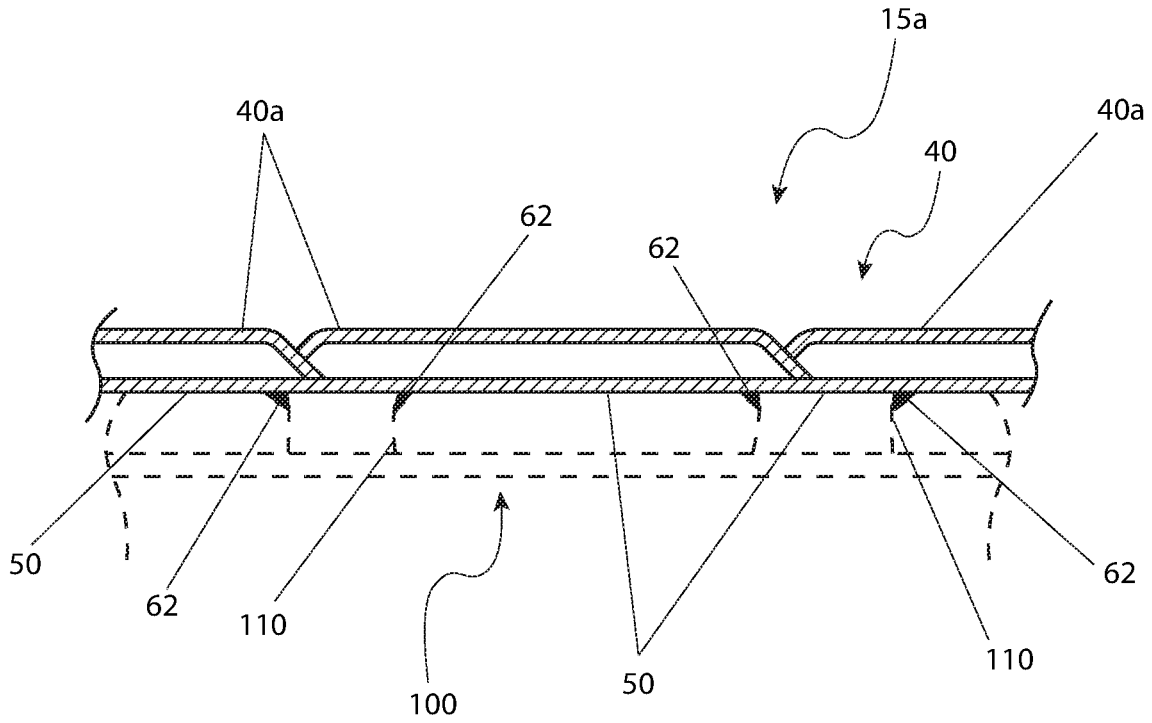

The modes for carrying out the invention are presented in terms of its preferred embodiments, herein depicted within FIGS. 1-4, and in terms of an alternate embodiment, herein depicted within FIG. 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a double-walled waste container (herein described as the "container") 10, which provides an open-top roll-off container being rectangular in shape and having double door portions 20*a*, 20*b* at one end. The container 10 employs a double wall construction 40, 50 to minimize damage during use. Additionally, the container 10 provides a plurality of drain apertures 60 to provide a means of liquid drainage to prevent corrosion of the container 10.

Figure 2:
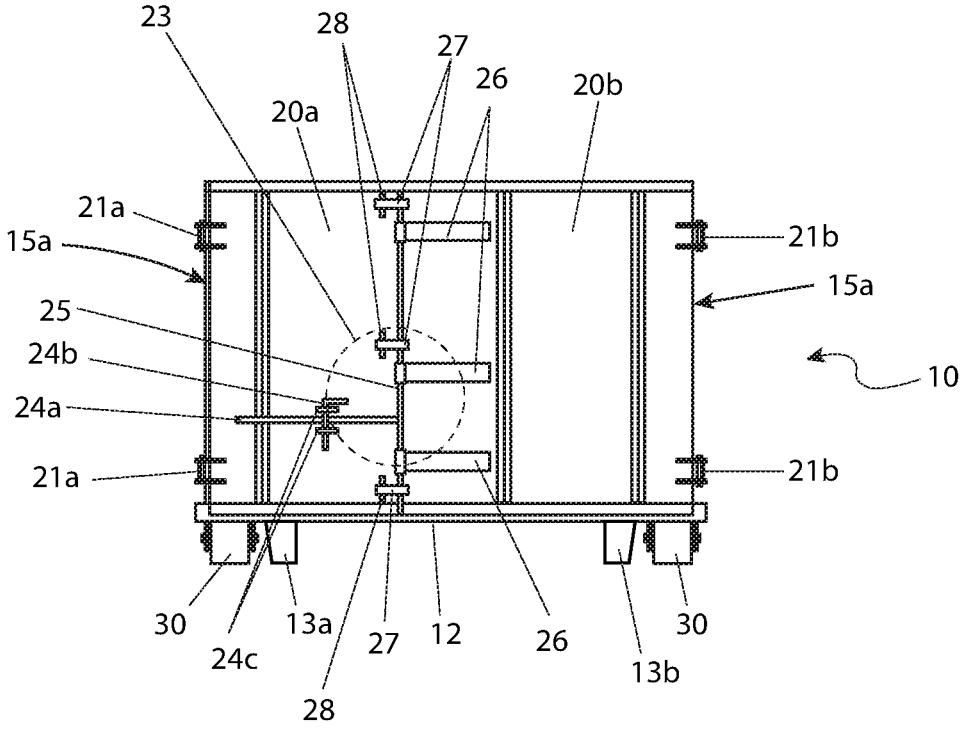
FIG. 2 is a front perspective view showing the door assembly 20*a*, 20*b* of the double-walled waste container 10, according to an embodiment of the present invention.

Referring now to the FIGS. 1 and 2, side and end views of the container 10, according to a preferred embodiment, are disclosed. An embodiment of the container 10 is illustrated here having two sidewalls 15*a*, a rear wall 15*b*, a cap weldment 14, a floor weldment 12, a left side door half 20*a*, a right side door half 20*b*, at least two wheel assemblies 30, a first rail 13*a*, a second rail 13*b* with each having a cantilevered portion 16 (only visible on FIG. 1). As seen here, the two side-walls 15*a* and the rear wall 15*b* are to be affixed in a perpendicular manner to the floor weldment 12 via a welding process. Additionally, the cap weldment 14 affixes to entire top edge portions of each of the sidewalls 15*a* and the rear wall 15*b* also using a welding process. The floor weldment 12 and cap weldment 14 provide additional structural support and strength to protect the container 10 from damage during top loading.

The embodiment of the container 10 illustrated here provides a pair of wheel assemblies 30 which are welded to opposing bottom portions of one end of the floor weldment 12, thereby allowing the container 10 to be more easily transported and loaded on to and off of a truck or other similar vehicle. The wheel assemblies 30 enable the container 10 to be filled at one location and transported to another location for unloading. The first rail 13*a* and second rail 13*b* with each having a cantilevered portion 16 facilitate the sliding of the container 10 onto and off the bed of a transportation vehicle. Some embodiments of the container 10 may include additional wheel assemblies 30 for improved mobility.

As shown here, the container 10 includes a left side door half 20*a* and a right side door half 20*b* which join together to close one end of the container 10. The embodiment of the container 10 shown here includes a left door half 20*a* and a right door half 20*b*, each being pivotingly attached to opposing vertical edges of opposing sidewalls 15 via respective left side hinges 21*a* and right side hinges 21*b*. The doors 20*a*, 20*b* swing outwardly to allow access to the interior of the double-walled waste container 10.

The door halves 20*a*, 20*b* are to be secured to each other in a planar manner via a door latch weldment 23 which includes portions which are welded or otherwise affixed to the door halves 20*a*, 20*b*. Affixed to the left door half 20*a* are a plurality of welded latches 28 and a welded locking plate 24*c*. Affixed to the right door half 20*b* is a release bar 24*a*, a pivot rod 25, a plurality of welded rod brackets 26, and a plurality of hooks 27. Following rotation of the door halves 20*a*, 20*b* to a jointly planar position, an operator may rotate the release bar 24*a* to the left to secure the door halves 20*a*, 20*b* together. The release bar 24*a* is a portion of a door latch weldment 23 made up of the release bar 24*a*, the pivot rod 25, and the hooks 27. As the release bar 24*a* is pivoted to the left, the vertical pivot rod 25 rotates within the stationary rod brackets 26 together with the welded hook portions 28 which in turn engage the correspondingly positioned stationary latch portions 28 located upon the left door half 20*a*.

The operator may then secure the position of the door halves 20*a*, 20*a* by securing the release bar 24*a* to the locking plate portion 24*c* of the left door half 20*a* by inserting a locking pin 24*b* through the locking plate 24*c*.

In some embodiments of the container 10, the door assemblies 20*a*, 20*b* may comprise a single door that swings side-to-side, which latches to the sidewalls 15*a* in a similar manner as the previously described embodiment. Further embodiments may include a single door that opens downward or upward to facilitate dumping of the contents of the container 10 and/or to allow better access to the interior by a user as the door may act as a ramp in some embodiments. It is understood that the teachings of the container 10 may be integrated into designs of various waste containers having various standardized volumetric sizes with equal benefit, such as, but not limited to: ten cubic yards (10 $yd^3$), twenty cubic yards (20 $yd^3$), thirty cubic yards (30 $yd^3$), forty cubic yards (40 $yd^3$), and the like, and as such should not be interpreted as a limiting factor of the container 10.

It is understood that the door halves 20*a*, 20*b* may further provide a double-wall construction including inner wall 50 and outer wall portions 40*a* similar to that of the sidewalls 15*a* and rear wall 15*b* (as discussed in FIGS. 3*a* and 3*b* below).

Referring now to FIGS. 3*a*, 3*b* and 3*c*, cross-sectional representations of one of the walls 15*a*, 15*b*, are disclosed. Each of the two sidewalls 15*a* and the rear wall 15*b* include welded portions including an outer wall 40 and an inner wall 50. An embodiment of the outer wall 40 is shown in FIG. 2, including a plurality of "U"-shaped vertical outer wall portions 40*a* being overlapped and welded to the inner wall 50 to form a strong corrugated structure to increase structural rigidity and to allow a reduction of construction materials compared to similar existing waste containers 100. It is understood that the outer wall 40 may also be a single panel having a formed corrugated profile, thereby providing simplified fabrication and ease of construction, and as such should not be interpreted as a limiting factor of the container 10 as illustrated in FIG. 3*c*.

The inner wall 50 comprises a flat and smooth arrangement to allow materials deposited in the container 10 to easily be removed by tilting and dumping. The configuration of the inner wall 50 and the outer wall 40 are such that when heavy materials are deposited into the container 10 in a manner that causes damage to the container 10, the inner wall 50 sustains the damage and prevents damage to the outer wall 40. This maintains the strength of the container 10 as well as prolonging a like-new appearance when viewed externally.

The configuration of the inner wall 50 and the outer wall 40, together, increases structural rigidity such that the thickness of the inner wall 50 and outer wall 40 may be reduced such that overall weight and cost of materials of the container 10 may be lower in comparison to similar existing waste containers 100. This overall reduction in weight may also reduce operating and fuel costs for transportation and storage of the double-walled waste container 10.

Referring now to FIG. 4, a close-up sectional view of an interface of sidewall 15*a* and floor weldment 12 portions, is disclosed. The arrangement and welding of the inner wall 50 and outer wall portions 40*a* of the sidewalls 15*a* are affixed to the floor weldment 12 as illustrated here. The floor weldment 12 also comprises a plurality of drain apertures 60 which may be longitudinal, oval-shaped, circular in shape, in different embodiments of the container 10. The drain apertures 60 allow water or other liquids to drain from the void or space between the inner wall 50 and the outer wall 40 to reduce the amount of rust and corrosion to the container 10, thereby increasing useable life.

The exact specifications, materials used, and method of use of the container 10 may vary upon manufacturing.

Referring now to FIG. 5, a sectional view along a horizontal plane depicting attachment of a sidewall portion 15*a* to an existing waste container 100, according to an alternate embodiment of the invention, is disclosed. The teachings of the previously described container 10 may be applied to strengthen or repair wall portions of existing waste containers 10 via attachment of the double-walled sidewall portion 15*a* to the external surfaces. A welding process or equivalent methods such as rivets, fasteners, and the like, may be utilized to affix sections of the inner wall 50 to protruding channel-shaped gusset portions 110 of the existing waste container 100. The attachment of the sidewall 15*a* would not only provide the previously stated advantages of the sidewall 15*a*, but also act to cover existing dents, penetrations, and other previously received damage to external wall portions of the existing waste container 100. Additionally, the attachment of the sidewall 15*a* would act to restore a like-new external appearance.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be utilized as indicated in FIGS. 1 and 2.

The method of utilizing the device 10 may be achieved by performing the following steps: procuring a model of the container 10 having a desired internal volumetric size; transporting the container 10 using a special truck, or similar suitable vehicle, to a site for waste loading; unloading the container 10 upon a ground surface using the wheel assemblies 30 to help roll the container 10 into place; configuring the container 10 for ground-level loading, if desired; opening the door halves 20*a*, 20*b* by removing the locking pin 24*b*; rotating the release bar 24*a* to disengage the hooks 27 from the latches 28; pivoting one of both of the door halves 20*a*, 20*b* about the hinges 21*a*, 21*b* until the end of the container 10 is accessible; utilizing the container 10 to carry loads of construction and demolition waste or similar types of debris as needed or until full; closing the door halves 20*a*, 20*b* by reversing the aforementioned steps; continuing to load waste materials into the container, if desired, into the open-top portion as needed or until the container 10 is full; utilizing the drain aperture features 60 of the container 10 to remove any liquids which may accumulate within the container 10; transporting the container 10 as previously described to a waste disposal site; utilizing the special transport vehicle to tilt the container 10 to dump and empty its contents; and, benefiting from a waste container 10 with improved strength, reduced corrosion, and lasting like-new appearance, afforded a user of the present invention 10.

The method of utilizing the alternate repair of an existing waste container 100 using sidewall portions 15*a* may be achieved by welding sections of the double-walled sidewall 15*a* to protruding channel-shaped gusset portions 110 of an existing waste container 100, and utilizing the strengthened and repaired existing waste container 100 in a similar manner as the previously described container 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A waste container, comprising:

a first sidewall;

a second sidewall;

an end wall extending between the first and second sidewalls;

a floor extending substantially between the first and second side walls, wherein the first and second sidewalls and the floor define an interior of the waste container for receiving waste;

wherein one or both of the first and second sidewalls comprises a double-wall configuration comprising a first wall and a second wall fixedly secured to the first wall, the second wall comprises a plurality of adjacent second wall portions, each adjacent second wall portion defines an inner wall portion and edge wall portions located on substantially opposite sides of the inner wall portion relative to each other and angled relative to the inner wall portion, each angled edge wall portion is welded to an adjacent angled edge wall portion and/or to the first wall to fixedly secure the second wall to the first wall, the first and second walls define a plurality of vertically extending spaces therebetween, and the floor defines at least one drain aperture located below and in fluid communication with one or more vertically extending spaces in the double wall to allow fluid drainage from the sidewall of the waste container therethrough.

2. The waste container of claim 1, wherein the floor defines a plurality of drain apertures, and each drain aperture is aligned with one or more vertically-extending spaces in the double wall for draining fluid therefrom.

3. The waste container of claim 1, wherein both the first and second sidewalls define the double-wall configuration, and the floor defines at least one first drain aperture located below the first sidewall and in fluid communication with one or more vertically-extending spaces therein, and at least one second drain aperture is located below the second sidewall and is in fluid communication with one or more vertically-extending spaces therein.

4. The waste container of claim 1, wherein the floor defines a plurality of drain apertures, and each drain aperture is one or more of longitudinal shaped, oval shaped or circular shaped.

5. The waste container of claim 1, wherein each vertically-extending space extends from approximately a top of the double wall to approximately a bottom of the double wall.

6. The waste container of claim 5, wherein each vertically-extending space further extends laterally between the angled edge wall portions of the respective second wall portion.

7. The waste container of claim 1, wherein one or both of the first and second sidewalls comprises a double-wall configuration and a cap affixed to an upper edge of the sidewall and covering the vertically-extending spaces therein.

8. The waste container of claim 1, wherein the first wall is substantially flat, a plurality of the inner wall portions are substantially flat, and each substantially flat inner wall portion is approximately parallel to the first wall.

9. The waste container of claim 1, wherein each angled edge wall portion is oriented at an acute angle relative to the respective inner wall portion.

10. The waste container of claim 1, wherein a plurality of angled edge wall portions overlap and are welded to each other.

11. The waste container of claim 1, wherein a plurality of second wall portions include one angled edge wall portion welded to an adjacent angled edge wall portion and another angled edge wall portion welded to the first wall.

12. The waste container of claim 11, wherein a plurality of angled edge wall portions welded to each other are oriented approximately perpendicular to each other.

13. The waste container of claim 1, wherein the second wall forms a substantially flat exterior surface defined by adjacent substantially flat inner wall portions and welds extending between adjacent angled edge wall portions.

14. The waste container of claim 13, wherein one or more of the substantially flat wall portions are wider than other substantially flat wall portions.

15. The waste container of claim 1, wherein each second wall portion is substantially U-shaped, the inner wall portion defines the base of the U-shape and the angled edge wall portions form the legs of the U-shape.

16. The waste container of claim 1, wherein a plurality of the second wall portions are contiguous, and each of a plurality of such second wall portions include contiguous angled edge portions on at least one side thereof.

17. The waste container of claim 1, further comprising an end wall extending between the first and second sidewalls and further defining the interior space of the waste container, wherein the end wall comprises at least one door hingedly mounted thereon and movable between a closed position and an open position for accessing the interior space of the waste container, wherein the door rests on the underlying floor and/or end wall when in the closed position.

18. The waste container of claim 17, further comprising another end wall spaced relative to the other end wall and further defining the interior space of the waste container, wherein each end wall extends between the first and second side walls.

19. The waste container of claim 17, wherein one or both of the end walls also comprise the double wall configuration.

20. The waste container of claim 1, wherein the first and second sidewalls both comprise the double wall configuration.

21. The waste container of claim 1, wherein the first wall of the double wall configuration is an interior wall of the waste container, and the second wall of the double wall configuration is an exterior wall of the waste container.

22. A waste container, comprising:

a first sidewall;

a second sidewall;

an end wall extending between the first and second sidewalls;

a floor extending substantially between the first and second side walls, wherein the first and second sidewalls and the floor define an interior of the waste container for receiving waste;

wherein one or both of the first and second sidewalls comprises a double-wall configuration including a first wall and a second wall fixedly secured to the first wall, the second wall includes a plurality of adjacent second wall portions, each adjacent second wall portion includes first means for forming a substantially flat exterior, and a plurality of second means located on opposite sides of the first means and angled relative thereto for fixedly attaching the second means to an adjacent second means and/or to the first wall and thereby fixedly secure the second wall to the first wall, wherein the first and second walls define a plurality of vertically-extending spaces therebetween, and the floor includes third means located below and in fluid communication with one or more vertically-extending spaces in the double wall for allowing fluid drainage therethrough.

23. The waste container of claim 22, wherein each first means is a substantially flat inner wall portion, each second means is an edge wall portion, and each third means is an aperture extending through the floor.

24. The waste container of claim 22, wherein each second means is welded to an adjacent second means and/or to the first wall to fixedly secure the second wall to the first wall.

25. A method comprising the following steps:

(i) forming a double-wall configuration sidewall of a waste container by fixedly securing at least one of a first sidewall or a second sidewall to the other, wherein the second sidewall includes a plurality of second wall portions, each second wall portion includes an inner wall portion and edge wall portions located on substantially opposite sides of the inner wall portion and angled relative thereto, and the fixedly securing includes welding a plurality of angled edge wall portions to adjacent angled edge wall portions and/or to the first wall; and (ii) mounting a first sidewall and a second sidewall on a floor, spacing the first and second sidewalls relative to each other and defining an interior space therebetween, wherein one or both of the first and second sidewalls defines the double-wall configuration of step (i).

26. The method of claim 25, wherein step (i) further includes forming a plurality of vertically-extending spaces between a plurality of second wall portions and the first wall; and the method further includes forming at least one drainage aperture in or through the floor located below and in fluid communication with one or more vertically-extending spaces in the double wall to allow fluid drainage therethrough.

27. The method of claim 26, further including affixing a cap to an upper edge of the double-walled sidewall and covering the vertically extending spaces therein.

28. The method of claim 25, wherein step (i) further includes:

(a) welding an angled edge portion of a second wall portion to the first wall, and welding an opposite angled edge portion of the second wall portion to an angled edge portion of an adjacent second wall portion; and (b) repeating the foregoing step for a plurality of second wall portions.

29. The method of claim 28, further comprising performing step (a) for a second wall portion, and then repeating step (a) for a plurality of contiguous second wall portions until substantially the entire second wall is fixedly secured to the first wall.

30. The method of claim 25, further comprising forming a substantially flat exterior sidewall of the waste container defined by adjacent substantially flat inner wall portions and welds extending between adjacent angled edge wall portions.

31. The method of claim 25, further comprising forming the second wall with one or more of the substantially flat wall portions that are wider than other substantially flat wall portions.

* * * * *